US007993515B2

(12) United States Patent
Davies et al.

(10) Patent No.: US 7,993,515 B2
(45) Date of Patent: Aug. 9, 2011

(54) SURFACE SKIMMING DEVICE FOR POOLS

(76) Inventors: Mark Allan Davies, Chermside (AU); Paul Maarten Degroot, Chermside (AU)

( * ) Notice: Subject to any disclaimer, the term of this patent is extended or adjusted under 35 U.S.C. 154(b) by 284 days.

(21) Appl. No.: 12/377,999

(22) PCT Filed: Aug. 24, 2007

(86) PCT No.: PCT/AU2007/001229

§ 371 (c)(1),
(2), (4) Date: Feb. 18, 2009

(87) PCT Pub. No.: WO2008/022408

PCT Pub. Date: Feb. 28, 2008

(65) Prior Publication Data

US 2010/0230336 A1 Sep. 16, 2010

(30) Foreign Application Priority Data

Aug. 25, 2006 (AU) ..... 2006904615

(51) Int. Cl.
*E04H 4/12* (2006.01)
*E04H 4/16* (2006.01)

(52) U.S. Cl. ..... 210/167.2; 210/232; 210/416.2

(58) Field of Classification Search ..... 210/167.1, 210/167.19, 232, 242.1, 416.1, 416.2, 167.2
See application file for complete search history.

(56) References Cited

U.S. PATENT DOCUMENTS

| | | | | |
|---|---|---|---|---|
| 3,616,918 | A | 11/1971 | Diemond et al. | |
| 4,212,740 | A | 7/1980 | Greene | |
| 4,325,150 | A | 4/1982 | Buddy | |
| 4,501,659 | A | 2/1985 | Henk | |
| 6,224,753 | B1 * | 5/2001 | Marbach | 210/122 |
| 6,406,621 | B1 * | 6/2002 | Bates et al. | 210/170.05 |
| 6,716,342 | B1 | 4/2004 | Tilsner | |

FOREIGN PATENT DOCUMENTS

AU 1987068645 A1 8/1987

* cited by examiner

*Primary Examiner* — Fred Prince
(74) *Attorney, Agent, or Firm* — Kirton & McConkie; Evan R. Witt

(57) ABSTRACT

A pool skimming device comprising an outer body with an outlet to the pool pump line, a hollow mating member which floats within the outer body so that its top rim is at the surface of the pool and a litter basket which fits within the floating member. The device has an inlet to attach a pool suction device and the outer body has a backing plate which fits over the opening of the pool skimmer box which provides access to the pool pump line.

9 Claims, 5 Drawing Sheets

SURFACE SKIMMING DEVICE FOR POOLS

FIELD OF THE INVENTION

This invention relates to devices for skimming the surface water of pools and in particular swimming pools where the level of the pool can fluctuate over a wide range.

BACKGROUND OF THE INVENTION

In conventional swimming pools the surface layer of water is drawn off via skimmer boxes built into the top of the side walls of the pool. The water is filtered in the box to remove any litter floating on the surface and returned to the pool via nozzles which are usually located in the pool wall opposite the skimmer box. There are also devices used in conjunction with skimmer boxes which crawl over the floor and walls of the pool sucking up debris into the filter in the skimmer box.

However the problem with conventional skimmer boxes is that they only skim effectively when the surface level of the pool is kept within a narrow range, usually less than 80 mm. Accordingly if the level falls below the bottom ledge of the box opening no water is removed from the pool. Or if the level rises above the box opening, the sub-surface water is removed and litter is left floating on the surface.

A variety of devices have been developed to skim the surface water from pools where the water level varies over a wide range. For example U.S. Pat. No. 4,325,150 has an inner concentric cylinder containing a strainer basket and floats within an outer concentric cylinder which attaches to a suction hose. U.S. Pat. No. 4,212,740 has a similar construction but has a weir, the lip of which floats at the water surface level. However both of these require separate plumbing arrangements and appear to be free floating.

U.S. Pat. No. 6,187,181 and U.S. Pat. No. 5,078,863 teach similar but more complicated arrangements of the above constructions while WO 97/49882 discloses a suction powered automatic crawler the buoyancy of which can be adjusted so that it floats at the surface of the water and skims the surface layer. However all of these arrangements involve many moving parts and are prone to failure requiring heavy maintenance.

The device of U.S. Pat. No. 4,501,659 has a semi cylindrical outer body mounted on the pool wall and an inner mating semi cylindrical body floating within it. It is superficially similar to the device of the present invention but works on a quite different principle. Water is injected into the bottom of the outer body from a nozzle protruding from the pool wall and passes out through a nozzle in the opposite cylindrical wall of the outer body. This is said to create a reduction in pressure at the base of the outer body and water is drawn into the floating body from the surface of the pool. It is designed to be fitted over an existing high pressure water jet in the wall of the pool and not at a suction skimmer box as the present invention.

OBJECT OF THE INVENTION

It is therefore an object of the present invention to provide a suction skimming device for pools which overcomes the above disadvantages of the prior art or at least provides a useful alternative.

STATEMENT OF THE INVENTION

According to the present invention a pool skimming device comprises an outer body with an outlet to the pool pump line, a hollow mating member which floats within the outer body so that its top rim is at the surface of the pool and a litter basket which fits within the floating member.

Preferably the outer body is adapted to attach to the built in pool skimmer box and the outlet connects to the pool pump line via the skimmer box.

Preferably the outer body, the litter basket and the floating member are semi cylindrical in cross section.

Preferably the outer body has an inlet to attach a pool suction device.

Preferably the back of the outer body fits over the opening of the pool skimmer box.

Preferably the device has a supporting bracket attached to the pool wall around the skimmer box.

Preferably the outlet to the pool pump line is a pipe extending from the back of the base of the outer body upwards into the skimmer box.

Preferably the back of the outer body has a hollow recess to accommodate the outlet pipe.

Preferably the outlet pipe is located in the opening of the skimmer box by an expandable wedge attached to the pipe.

In an alternative form a pool skimming device comprises a cavity built into the side of the pool which has a vertically extended opening to the pool, a hollow mating member which floats within the cavity so that its top rim is at the surface of the pool, a litter basket which fits within the floating member and an outlet to the pool pump line.

BRIEF DESCRIPTION OF THE DRAWINGS

An embodiment of the invention is now described by way of example only with reference to the accompanying drawings in which.

DETAILED DESCRIPTION OF THE INVENTION

Figure 1:
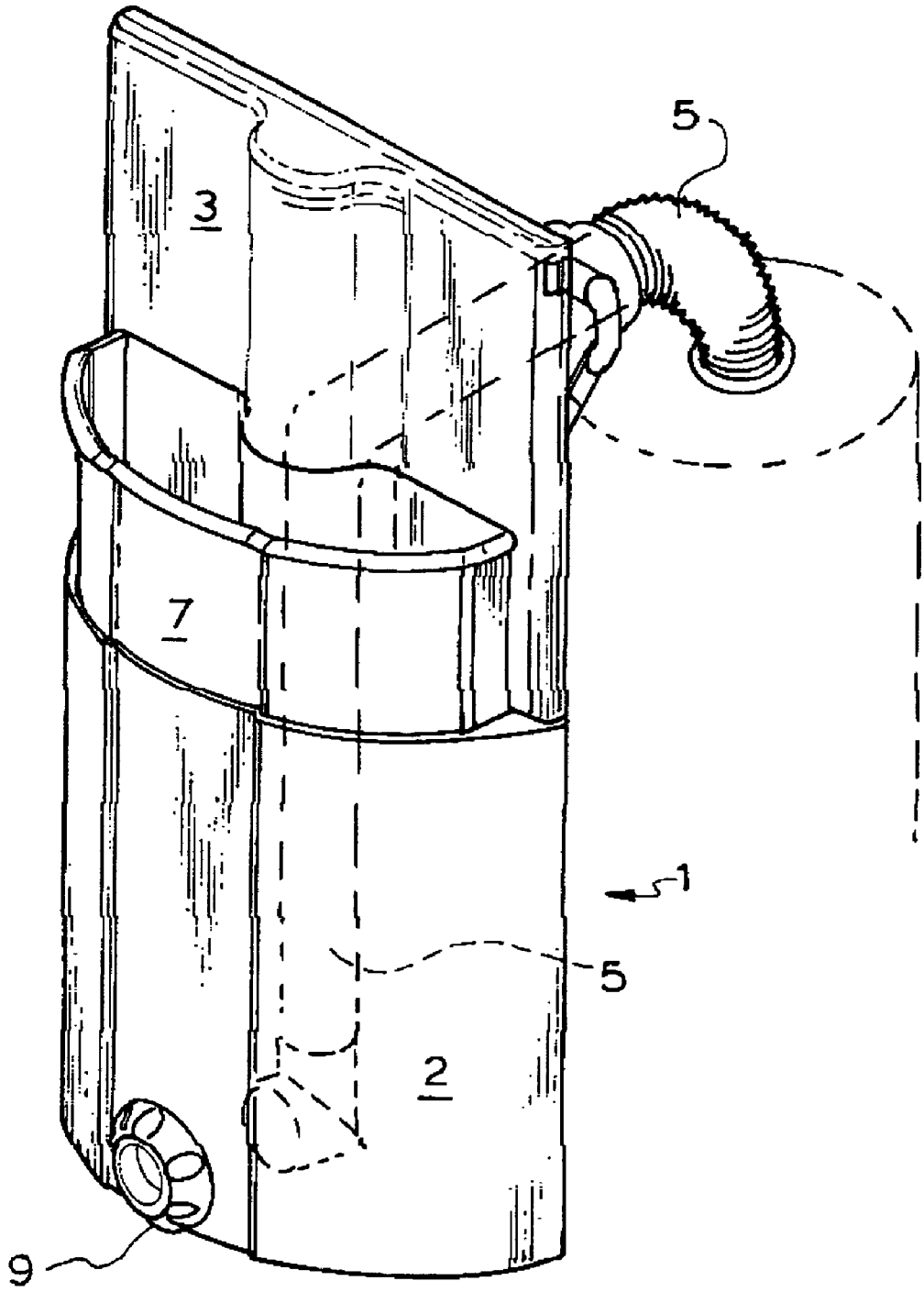
FIG. 1 is a front perspective view of a pool skimming device
Figure 2:
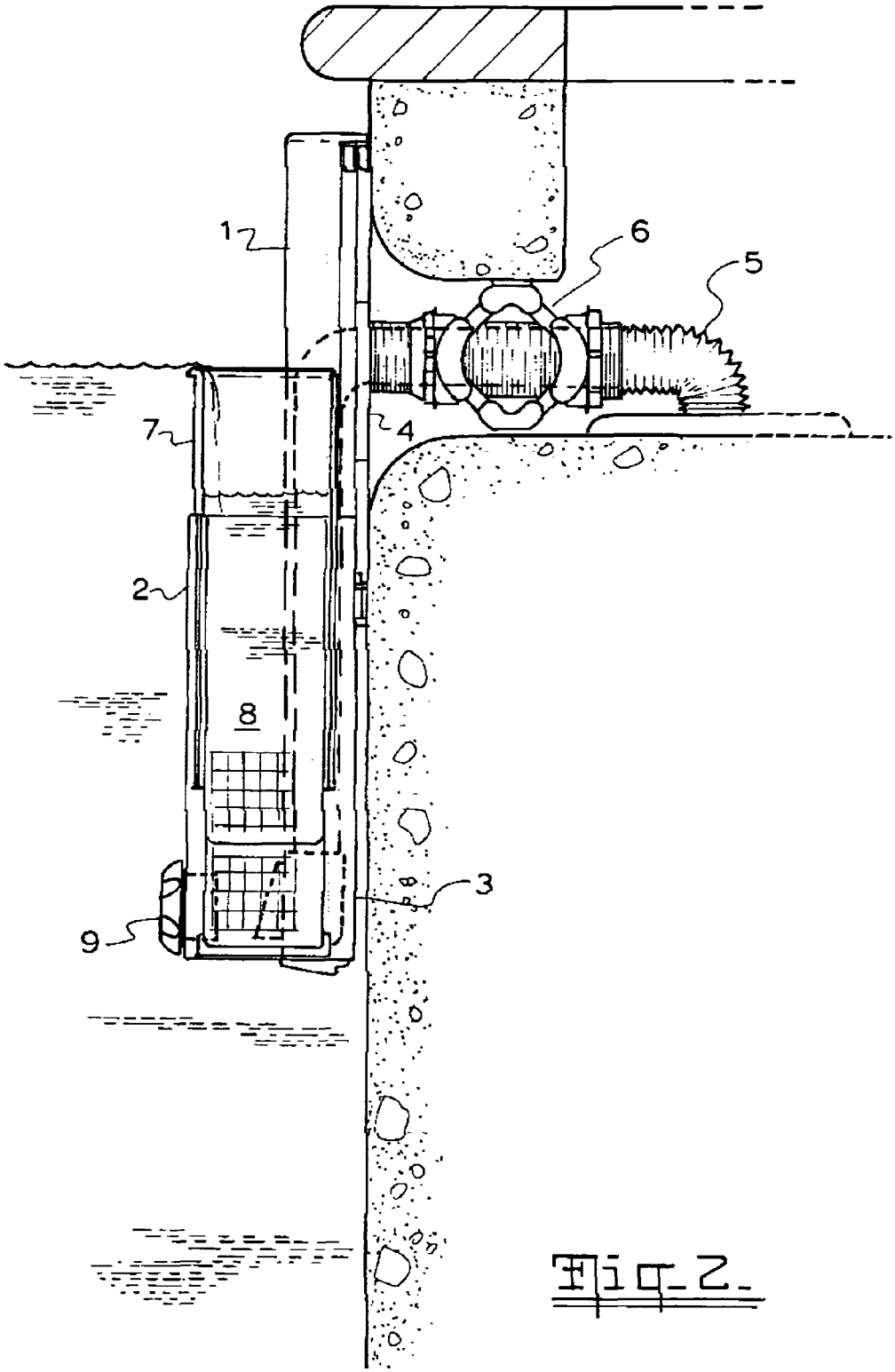
FIG. 2 is a vertical cross section of the device of FIG. 1 in situ
Figure 3:
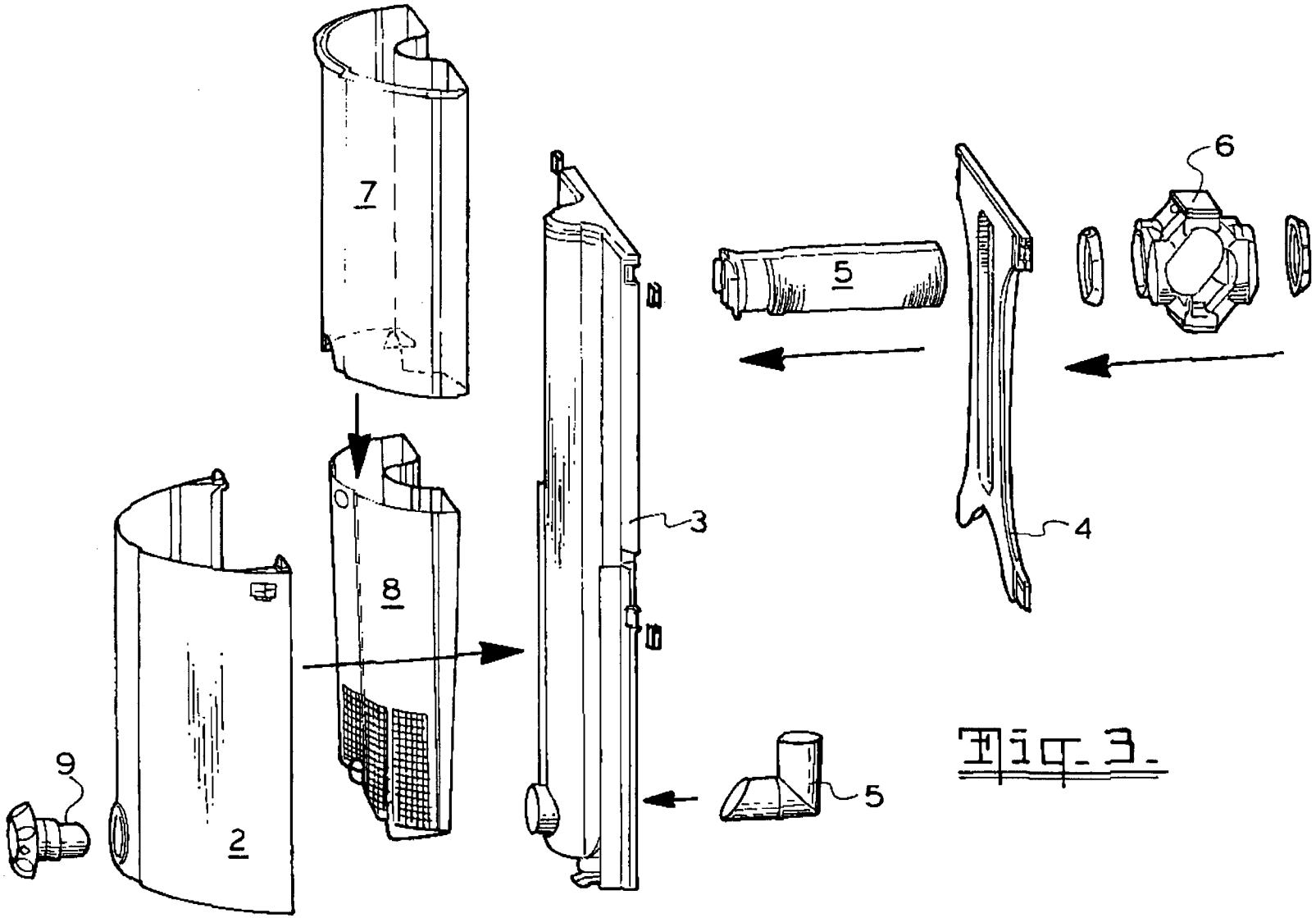
FIG. 3 is an exploded view of the device shown in FIG. 2

FIGS. 1, 2 and 3 show outer body 1 of a skimming device consisting of a semi cylindrical front wall 2 and a flat backing plate 3. Outer body 1 is mounted on support bracket 4 which is fixed over the opening of the pool skimmer box. Outlet pipe 5 extends from the base of outer body 1 upwards within a hollow recess in the back of outer body 1 and enters the opening of the pool skimmer box. Outlet pipe 5 is located in the opening of the pool skimmer box by expandable wedge 6 and fits into the cover plate of the skimmer box.

Floating member 7 fits into outer body 1 and is free to float so that its top rim is at the pool water level. Litter basket 8 fits inside floating member 7 in order to filter the water passing through floating body 7 and is easily removed to empty litter. Accordingly when the pool pump is operating floating member 7 is drawn just below the water level and the surface layer is skimmed into basket 8 which catches any litter. Inlet 9 is provided at the base of front wall 2 to also allow connection of an automatic pool cleaning device.

It will be obvious that retrofitting this device to the skimmer box of a pool allows effective skimming of the surface over a wider range of water level than that provided by the opening in the skimmer box itself. Typically the device allows a variation in pool level of 330 mm. Accordingly it is not necessary to constantly top the pool up as evaporation takes place nor to drain water out of the pool when it rains and the water level rises above the skimmer box opening.

Figure 4:
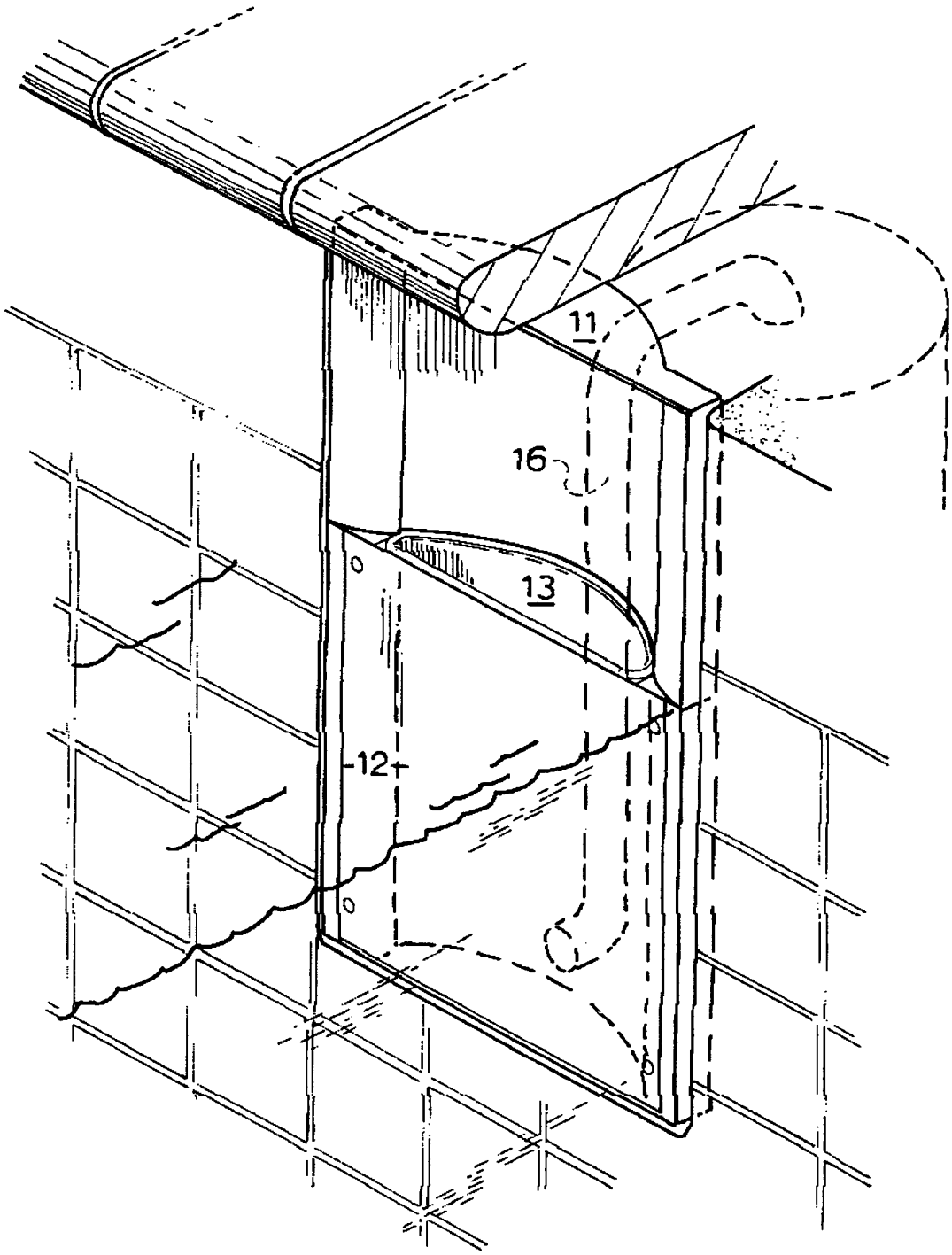
FIG. 4 is a view of a pool skimming device built into the wall of a pool and FIG. 5 is an exploded view of the device shown in FIG. 4.
Figure 5:
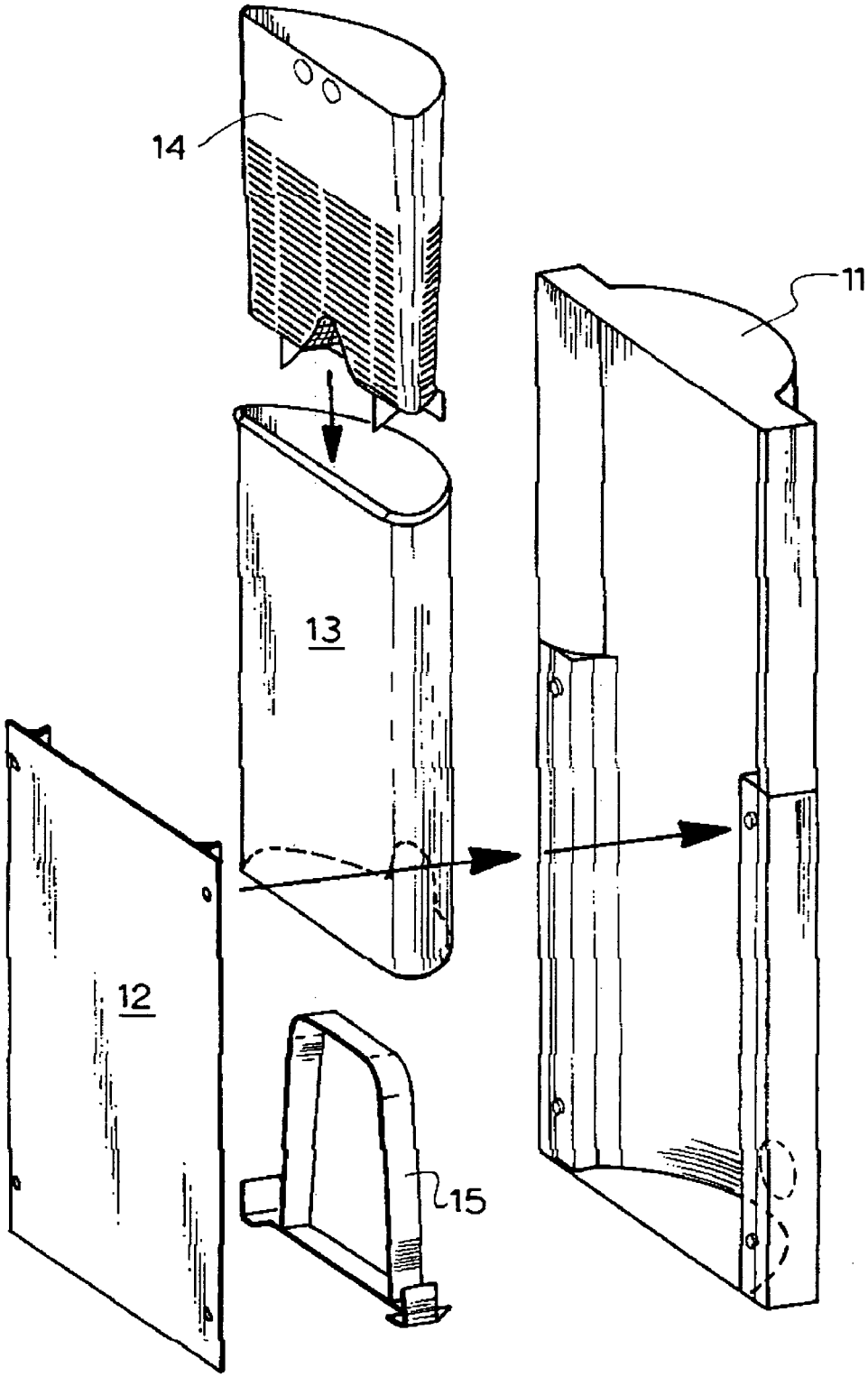

FIGS. 4 and 5 show a built in version of the retrofit device illustrated in FIGS. 1 to 3. In this device semi cylindrical outer body 11 fits into a mating opening in the pool wall which extends below the pool edging. Front plate 12 attaches to outer body 11 and retains floating member 13 which is free to float up and down with the pool level. Litter basket 14 fits within floating member 13 but is not as deep to allow removal through the opening between the top of plate 12 and the pool edging which is typically 330 mm. Stopper 15 is located in the bottom of floating member 13 to keep basket 14 in the top section of member 13 where it can be easily removed to empty litter.

Outlet pipe 16 extends from the base of body 11 upwards to connect with the pool pump line which is built into the pool wall similar to a pool skimmer box. Front plate 12 can also be provided with an inlet (not shown) to allow connection to an automatic pool cleaner. Accordingly this built in device operates in a similar fashion to the retrofit device above and can accommodate the same variation in water level.

VARIATIONS

It will be realized that the foregoing has been given by way of illustrative example only and that all other modifications and variations as would be apparent to persons skilled in the art are deemed to fall within the broad scope and ambit of the invention as herein set forth. Throughout the description and claims of this specification the words "comprise" and variations of that word such as "comprises" and "comprising" are not intended to exclude other additives components integers or steps.

The invention claimed is:

1. A pool skimming device comprising an outer body with an outlet to the pool pump line, a hollow mating member which floats within the outer body so that its top rim is at the surface of the pool and a litter basket which fits within the floating member, said outer body being adapted to attach to a built in pool skimmer box and the outlet connects to the pool pump line via the skimmer box.

2. The device of claim 1 wherein the outer body, the litter basket and the floating member are part cylindrical in cross section.

3. The device of claim 1 wherein the outer body has an inlet to attach a pool suction device.

4. The device of claim 1 wherein the back of the outer body fits over the opening of the pool skimmer box.

5. The device of claim 1 which has a supporting bracket attached to the pool wall around the skimmer box.

6. The device of claim 1 in which the outlet to the pool pump line is a pipe extending from the back of the base of the outer body upwards into the skimmer box.

7. The device of claim 1 in which the back of the outer body has a hollow recess to accommodate the outlet pipe.

8. The device of claim 1 in which the outlet pipe is located in the opening of the skimmer box by an expandable wedge attached to the pipe.

9. A pool skimming device comprising a cavity built into the side of the pool which has a vertically extended opening to the pool, a hollow mating member which floats within the cavity so that its top rim is at the surface of the pool, a litter basket which fits within the floating member an outlet to the pool pump line and an inlet to attach a pool suction device communicating with the bottom of the cavity.

* * * * *